United States Patent [19]

Fishman

[11] Patent Number: 4,785,704

[45] Date of Patent: Nov. 22, 1988

[54] MUSICAL INSTRUMENT TRANSDUCER

[76] Inventor: Lawrence R. Fishman, Green St. 5 Rear, Woburn, Mass. 01801

[21] Appl. No.: 876,989

[22] Filed: Jun. 19, 1986

[51] Int. Cl.[4] ..... G10H 3/18

[52] U.S. Cl. ..... 84/1.16; 84/DIG. 24

[58] Field of Search ..... 84/1.16, 1.14, DIG. 24, 84/1.04, 1.15, 1.06

[56] References Cited

U.S. PATENT DOCUMENTS 3,325,580 6/1987 Barcus ..... 84/1.16
4,147,084 4/1979 Underwood ..... 84/1.16
4,211,139 7/1980 Murakami ..... 84/1.16
4,491,051 1/1983 Borcus ..... 84/1.16

*Primary Examiner*—S. J. Witkowski
*Attorney, Agent, or Firm*—Wolf, Greenfield & Sacks

[57] ABSTRACT

A transducer for a stringed musical instrument incorporating an electrically conductive base plate along with a piezoelectric crystal secured to the base plate by a conductive adhesive. On the other side of the crystal from the base plate is disposed a spring for biasing the piezoelectric crystal against the bridge at a bridge or bridge/-body opening. Electrical leads are employed for coupling signals from the piezoelectric crystal.

23 Claims, 3 Drawing Sheets

Fig. 4
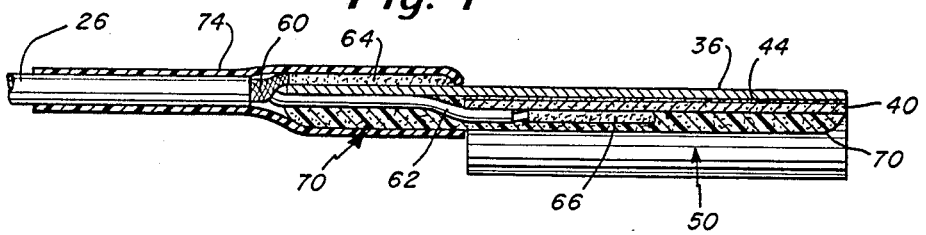
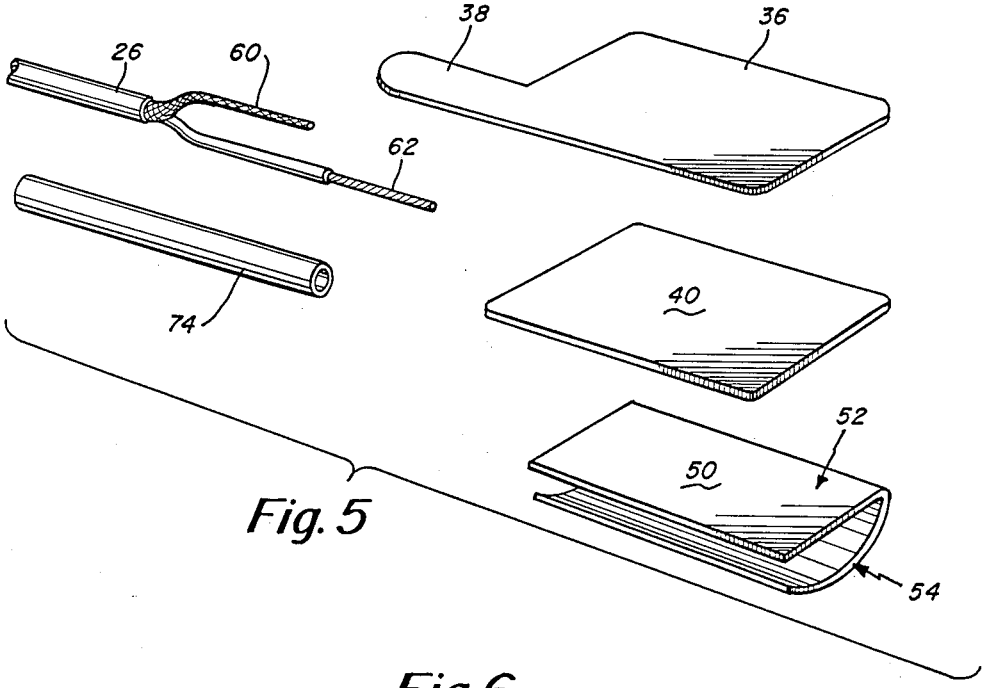
Fig. 5
Fig. 6
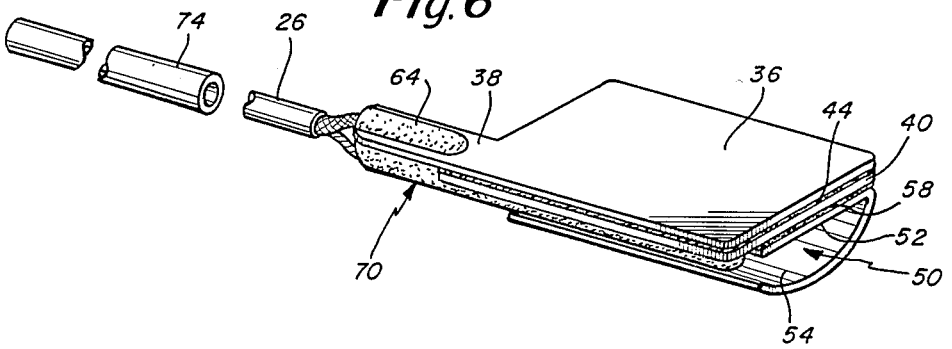

MUSICAL INSTRUMENT TRANSDUCER

BACKGROUND OF THE INVENTION

The present invention relates in general to a musical instrument transducer, and pertains, more particularly, to a piezoelectric transducer used with a stringed musical instrument. Although the transducer or the present invention is adapted preferably for use with a violin of viola, it may also be used in association with other stringed musical instruments such as a banjo, mandolin or arch-top style guitar.

At the present time, the prior art shows a variety of electro-mechanical transducers employing piezoelectric materials such as described in U.S. Pat. No. 3,325,580 to Barcus et al, U.S. Pat. No. 4,491,051 to Barcus and U.S. Pat. No. 4,147,084 to Underwood. Most of these piezoelectric transducers are not completely effective in faithfully converting mechanical movements or vibrations into electrical output signals which precisely correspond to the character of the input vibrations. This lack of fidelity is primarily due to the nature of the mechanical coupling between the driving vibratile member and the piezoelectric material. Some of these prior art structures such as shown in U.S. Pat. No. 4,491,051 are also quite complex in construction and become quite expensive to fabricate.

It is noted that the Barcus et al U.S. Pat. No. 3,325,580 as well as the Underwood U.S. Pat. No. 4,147,084 pertain to the use of piezoelectric transducers in association with a violin instrument. Both of these patents teach the use of the transducer in association with the bridge of the instrument disposed in slots in the bridge. Both of these patents teach the insertion of the transducer in a fixed, force-fit manner. For example, the Barcus et al U.S. Pat. No. 3,325,580 makes mention of the fact that the piezoelectric plates are forcibly pressed or wedged in the slotted openings provided in the bridge. It has now been found that this type of mounting severely restricts normal bridge action. There is a tendency for the transducer to cause a muting of the instrument and also, with these prior transducer constructions there are sensing surfaces on both sides of the crystal that comprises the transducer and thus in addition to picking up string vibrations there is a tendency for the system to also undesirably pick up instrument body noise. This is overcome in accordance with the present invention by single side sensing on the crystal as to be described in further detail hereinafter.

Accordingly, it is an object of the present invention to provide an improved piezoelectric transducer particularly for use with a stringed musical instrument such as a violin or viola.

Another object of the present invention is to provide an improved transducer as in accordance with the preceding object and which provides for the faithful conversion of string vibrations into electrical signals that substantially exactly correspond with the character of such vibrations.

Still a further object of the present invention is to provide an improved musical instrument transducer as in accordance with the preceding objects and which is relatively simple in construction, can be readily fabricated and which can also be constructed relatively inexpensively.

Another object of the present invention is to provide an improved musical instrument transducer that is readily adapted for retrofit to existing stringed instruments without requiring any modification thereto.

A further object of the present invention is to provide an improved piezoelectric transducer that is constructed so as to distribute a force over the entire surface of the transducer crystal thus providing a higher output of voltage and improved sensitivity.

Still another object of the invention is to provide and improved musical instrument transducer that employs substantially only one side crystal sensing so as to minimize the pick-up of instrument body noise.

A further object of the present invention is to provide an improved musical instrument transducer that is installed on the instrument bridge but that yet does not interfere with normal bridge action during instrument string actuation.

SUMMARY OF THE INVENTION

To accomplish the foregoing and other objects, features and advantages of the invention, there is provided a transducer for a stringed musical instrument. Although the transducer of the present invention is adapted preferably for a use with a violin, cello, bass violin or viola, it may also be used with other stringed instruments such as a banjo, a mandolin or an arch-top style guitar. The transducer of the invention is adapted for use with an instrument having a bridge. That, in the case of the violin or viola has at least one opening or slot therein for receiving the transducer, or in the case of the banjo, for example, has a slot or opening defined between the bridge and the body or head of the instrument. The transducer is adapted to be at least partially disposed in the bridge opening and comprises an electrically conductive base plate, a piezoelectric crystal, and means for fixedly supporting one side of the piezoelectric crystal to the base plate. The base plate may comprise a thin beryllium copper sheet having an end tab. Electrical lead means are provided for coupling signals from the piezoelectric crystal. The lead means may include a pair of conductors, one of which is soldered to the base plate tab. The other conductor may be soldered to the underside of the piezoelectric crystal. A conductive epoxy may be used for fixedly supporting the piezoelectric crystal with the base plate so as to provide not only positive interengagement but also electrical conductivity. A spring means is provided secured to the other side of the piezoelectric crystal for biasing the piezoelectric crystal against the bridge at the bridge opening. The spring means comprise a spring base and a resilient spring leaf integral therewith. An adhesive is used in securing the base to the other side of the piezoelectric crystal. The spring leaf extends in an arc shape from one edge of the spring base in a cantilever fashion. The bridge, or bridge and body in the case of some instruments, has opposite surfaces defining the transducer receiving opening. The spring base is positioned against one of those surfaces facing the strings while the spring leaf is seated against the other surface but urges the base plate into intimate contact with said one surface. Preferably an epoxy bead extend longitudinally to cover at least part of the lead means and along an edge of the piezoelectric crystal to provide support therebetween. The electrically conductive base plate enables distribution of forces over the entire surface of the crystal on one side thereof thus providing improved output voltage and improved sensitivity. The biasing spring means enables intimate contact on the sensing side of the crystal and provides for single side crystal sensing so as to minimize the pickup of instrument body noise. The spring means also enables normal operation of bridge action eliminating any muting that may occur by virtue of a force fit of the transducer with the bridge.

BRIEF DESCRIPTION OF THE DRAWINGS

Numerous other objects, features and advantages of the invention should now become apparent upon a reading of the following detailed description taken in conjunction with the accompanying drawing, in which:

FIG. 4 is a cross-sectional view taken along line 4—4 of FIG. 3 illustrating showing further details of the construction;

FIG. 5 is an exploded perspective view showing the components that comprise the stringed musical transducer of the present invention;

FIG. 6 is a perspective view showing the musical instrument transducer of this invention as in its completely assembled form;

DETAILED DESCRIPTION

Figure 1:
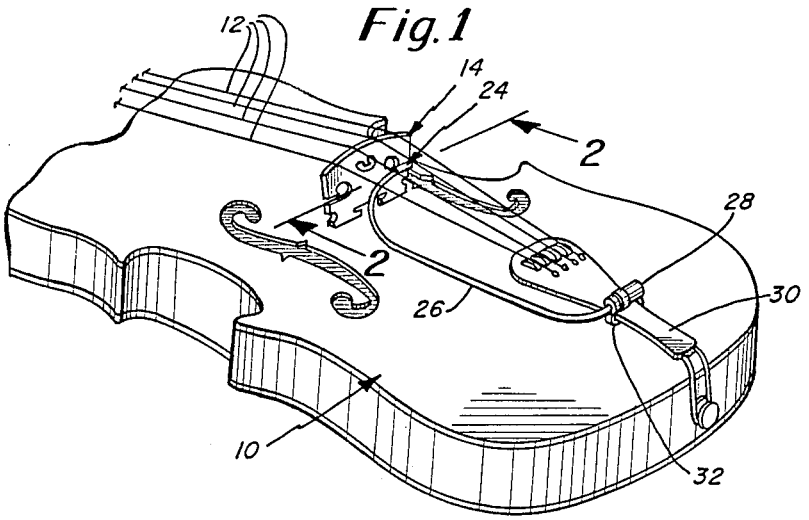
FIG. 1 is a perspective view showing a stringed musical instrument in the form of a violin with the piezoelectric transducer of the present invention secured in the bridge slot thereof.
Figure 2:
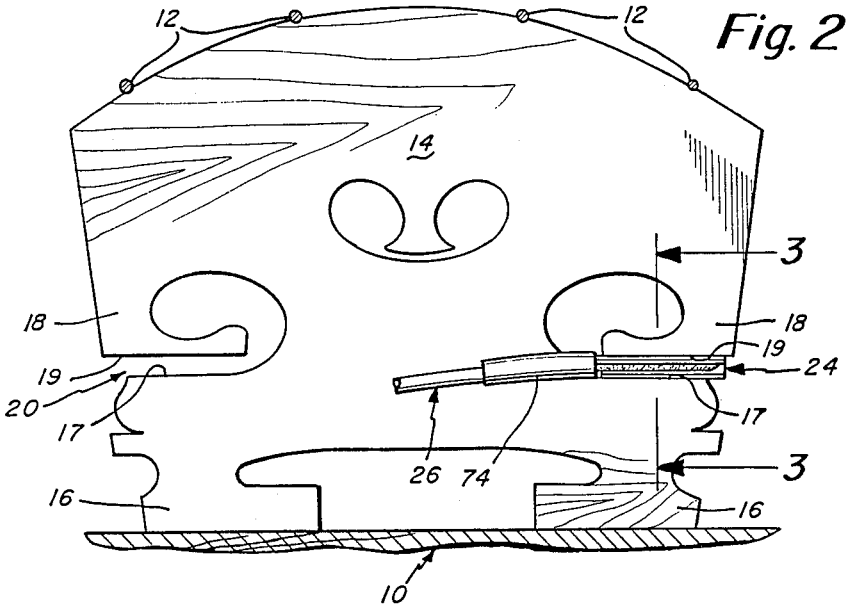
FIG. 2 is a cross-sectional view taken along line 2—2 of FIG. 1 showing more specific details of the placement of the transducer.
Figure 3:
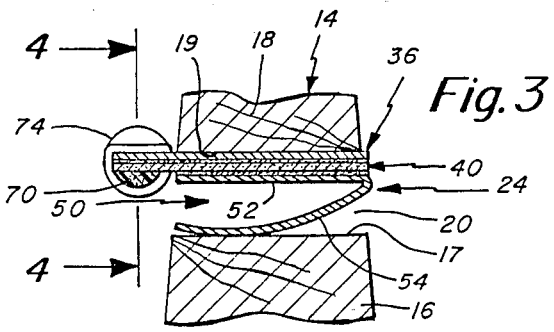
FIG. 3 is a cross-sectional view taken along line 3—3 of FIG. 2 clearly illustrating the manner of operation of the transducer and associated spring means for biasing the piezoelectric crystal against the bridge in the direction of the strings.
Figure 7:
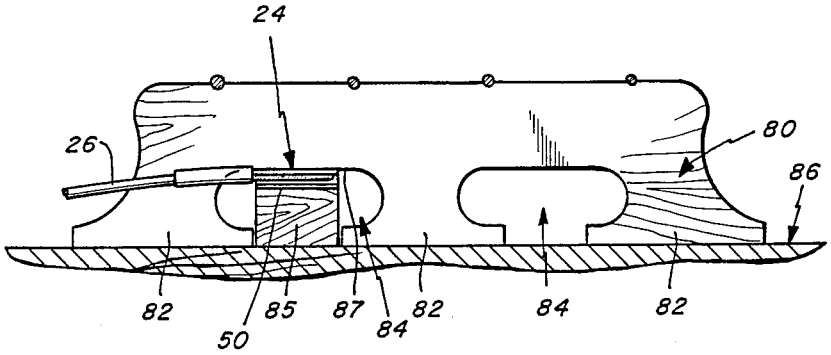
FIG. 7 illustrates the transducer of the present invention as employed with a banjo bridge.
Figure 8:
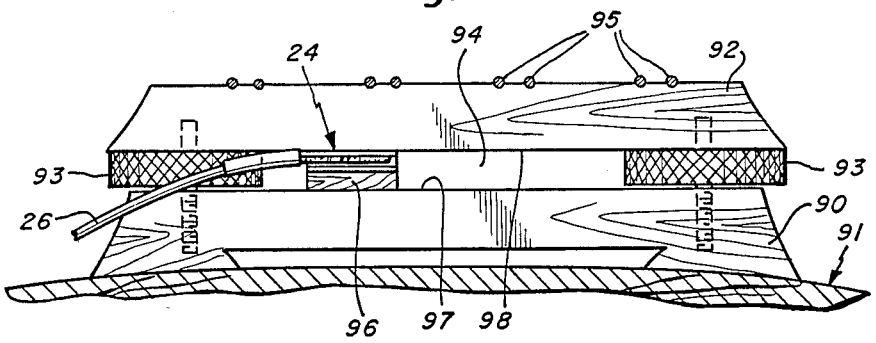
FIG. 8 illustrates the transducer of the present invention as employed with a mandolin or arch-top style guitar bridge.

FIG. 1 is a perspective view showing the transducer of the present invention as used in association with a violin. FIGS. 2 and 3 are cross-sectional views showing further details in particular the placement of the transducer in association with the instrument bridge. FIGS. 4–6 show further details of the construction of the violin/viola embodiment of the invention. FIG. 7 illustrates the transducer of the invention used with a banjo bridge and FIG. 8 illustrates the transducer as used with a mandolin or arch-top style guitar bridge.

Referring in particular to FIGS. 1–3, there is shown a violin 10 that is of conventional design incorporating a means for supporting a plurality of the strings 12. This support includes the instrument bridge 14. FIG. 2 shows the specific details of the bridge 14. In this regard the bridge 14 includes a pair of support legs 16, means for receiving the strings 12 at the top thereof, such as in the form of small string slots, and bridge wings 18. It is noted that a slotted opening 20 is provided on either side of the bridge between the legs 16 and 18. As illustrated in FIG. 2, one of slotted openings 20 receives the transducer of the present invention as illustrated in FIG. 2 at 24.

FIG. 1 shows the transducer 24 and associated conductor lead 26. Lead 26 couples to an output jack 28 which may be secured to member 30 by means of a nylon strap 32.

FIG. 3 illustrates the manner in which the transducer 24 is disposed in the slotted opening 20. FIGS. 4–6 show further details of the transducer 24. The transducer comprises an electrically conductive base plate 36 having at one end thereof the tab 38. Secured with the base plate 36 is the piezoelectric crystal 40. The piezoelectric crystal 40 is of a dimension substantially the same as that of the base plate 36 without the tab 38. The piezoelectric crystal 40 is to have conductive contact to the top and bottom surfaces thereof. For contact with the top surface of the crystal there is provided a conductive epoxy illustrated at 44 in the drawings. This conductive epoxy adhesive may be an epoxy that is silver filled to provide conductivity between the top surface of the crystal and the beryllium copper base plate 36. The base plate 36 may alternatively be comprised of other conductive metals such as brass.

The drawings also illustrate the spring means of the present invention in the form of the spring 50. The spring 50 comprises a spring base 52 and a spring leaf 54. The spring base 52 is adapted to be maintained in a fixed position and the spring leaf 54 is adapted to be deflectable. In this regard FIG. 3 shows the spring leaf 54 urged against the lower surface 17 defining the slotted opening 20. The compressed leaf 54 within the opening 20 urges the top part of the transducer at the electrically conductive base plate 36 into intimate contact with the top surface 19 (see FIG. 3) defining the slotted opening 20. The spring 50 is secured to the underside of the piezoelectric crystal by means of an epoxy adhesive such as illustrated at 58 in FIG. 6.

The aforementioned electrical lead 26 comprises a shielded cable including an outer conductor or shield 60 and a center conductor 62. The shield 60 is soldered to the top of the electrically conductive base plate at the tab 38 as indicated by the solder 64 in FIG. 6. Similarly, the center conductor 62 at its stripped end is soldered to the underside contact of the piezoelectric crystal as illustrated for example at 66 in FIG. 4.

To provide proper support between the electrical lead and the transducer body, there is provided an epoxy puddle or bead 70 as illustrated in FIGS. 4 & 6. The bead 70 extends longitudinally along the length of the piezoelectric crystal 40 and, as noted in FIG. 4, substantially encases the conductor lead 62 and solder connection 66. A heat shrink tube 74 extends over the end of the lead 26 as illustrated in FIG. 4, over the solder connection 64 surrounding the tab 38 and the associated portion of the epoxy bead 70.

The following are a sequence of steps carried out in constructing the transducer of the present invention. The electrically conductive base plate 36 and the crystal 40 are first joined together by the conductive epoxy adhesive. The conductive leads 60 and 62 are then soldered to the tab 38 and the underside of the crystal 40, respectively. The heat shrink tube 74 may be prepositioned on the lead 26, slid back from the conductors 60 and 62. The epoxy bead 70 is then formed by means of a mold. As is indicated in FIGS. 4 and 6, this epoxy bead extends from the area of the tab 38 through the full length of the face plate and the piezoelectric crystal. The epoxy bead provides a covering for the lead 62 and solder 66 and also provides a rigid support between the leads, crystal and the base plate.

The next step in the sequence is to properly position the heat shrink tubing such as to the position illustrated in FIGS. 2 and 4. The next step is to apply the spring 50 to the underside of the crystal by means of the epoxy 58. The transducer is then complete in assembly.

Accordingly, there has been provided in accordance with the present invention a transducer that is adapted to be easily mounted to a stringed musical instrument, particularly a violin or viola without requiring any modification to the bridge of the instrument. Rather that using the crystal alone, as in prior art applications, in accordance with the present invention the piezoelectric crystal is secured to a rigid member in the form of the described electrically conductive base plate 36. The crystal when bonded to this rigid member provides a bending motion. Also, the combination of the crystal and the rigid member 36 provides for even distribution of forces over the entire surface of the crystal thus providing improved output voltage and improved sensitivity.

Also in accordance with the invention is provided a spring means for mounting the transducer. This is much preferred in comparison with the previous techniques of force-fitting a double crystal construction in the bridge slot. This prior technique tended to restrict bridge action causing a muting of the instrument sound. Also, in the prior art construction because the crystal arrangement contacted both surfaces defining the slotted opening the transducer tended to pick up, not only string vibrations, but also instrument body noise. Accordingly, with the present invention this has been overcome by employing a spring member in combination with the piezoelectric crystal so as not to restrict normal bridge action. This arrange provides for sensing only at the upper surface of the crystal thus sensing only the string vibrations. Moreover, the spring arrangement of the invention assures intimate contact of the upper surface of the transducer with the upper surface defining the slotted opening.

In installing the transducer of the invention, the bridge of the instrument should be checked to make sure that the wing slots or openings at 20 have substantially flat parallel faces, free from warps or irregularities. The transducer is preferably slid into the treble side slot of the bridge as illustrated. The spring leaf 54 contacts the lower face of the slot and the sensing side of the transducer contacts the upper face of the slot as clearly illustrated, for example, in FIG. 3. The spring may be opened or closed by carefully bending the leaf 54 to accommodate different slot size openings. This will readily provide the proper tension for a snug fit in the slots for ranges from 0.050 inch to 0.090 inch slot width. If the slot in the instrument is larger than 0.090 inch such as in a viola a small wooden shim may be used. If this is used it may be glued to the lower face of the slot. The lead 26 is then run over the top of the tail piece 30 and the lead 26 with the jack 28 is secured in the manner previously described. If the installation is to be permanent a small amount of cement may be deposited of the spring side of the transducer between the leaf 54 and the surface 17.

FIG. 7 illustrates a banjo bridge that is adapted to receive the transducer of the present invention. FIG. 8 illustrates a mandolin or arch-top style guitar bridge that is also adapted to receive a transducer of the type described herein.

In FIG. 7 there is illustrated the banjo bridge 80 having three legs 82 defining therebetween two slots 84. The bridge 80 illustrated in FIG. 7 is conventionally attached to the banjo body surface. FIG. 7 illustrates the banjo body at 86. The banjo body is typically referred to as the head of the instrument. The bridge 80 may be secured to the head by an appropriate adhesive or other suitable means.

Because in the banjo the slots 84 are rather high the transducer 24 as associated therewith a wooden spacer 85 disposed in the slot 84. FIG. 7 also shows the conductive lead 26 coupling from the transducer 24. The transducer 24 illustrated in FIG. 7 is of the same construction as described previously and as illustrated in, for example, FIGS. 3–6. The electrically conductive base plate 36 of the transducer 24 is in intimate contact with the bridge surface 87 while the spring 50 is urged against the top of the wooden spacer 85. The spring 50 may be secured to the top surface of the wooden spacer 85 in a permanent installation. Also, the wooden spacer 85 may be adhesively secured in slot 84.

FIG. 8 illustrates a bridge that may be typically be used on a mandolin or arch-top style guitar. FIG. 8 illustrates this two part bridge that includes a bridge base 90 that is appropriately and conventionally secured to the body 91. The bridge also has a wood saddle 92. The wooden bridge base 90 and saddle 92 are interconnected by screw height adjusters 93. These adjusters 93 provide a slot 94 between the bridge base 90 and the saddle 92. The top of the saddle 92, of course, supports the strings as illustrated at 95.

The transducer 24 of the invention is disposed in the slot 94 between the bridge base and saddle and may have associated therewith a spacer 96 that is preferably in the form of a thin shim. The shim 96 rests upon the surface 97. The spacer 96 may be glued to the surface 97 by an appropriate adhesive. The electrically conductive base plate of the transducer 24 is urged against the surface 98 of the wood saddle 92. The transducer 24 is of the type described in FIGS. 3–6 and is positioned in the manner illustrated in FIG. 3 with the spring downwardly disposed and in contact with the wood spacer 96. If the installation is to be permanent a small amount of cement, glue or adhesive may be deposited on the spring side of the transducer between the leaf and the top surface spacer 96.

A reference has been made herein to the piezoelectric crystals. Although reference has been made to these devices as being piezoelectric crystals a more technically accurate term is piezoelectric ceramic. A crystal usually refers to a single crystal structure such as quartz. However, the materials employed herein are amorphous structures containing many thousand individual crystals. They are constructed by combining different elements in their powder form and subjecting them to high temperatures which forms a fused ceramic containing thousands of crystals. They are then subjected to high DC voltages which tends to align a majority of the dipoles and thus gives the entire structure a common polarity.

Having now described a limited number of embodiments of the present invention, it should now be apparent to those skilled in the art that numerous other embodiments in modification thereof are contemplated as falling within the scope of the present invention. For example, reference has been made herein to use of the transducer preferably in association with a violin or viola. However, it is understood that the present invention also has application in any stringed, such as the illustrated banjo bridge, instrument employing a bridge on which the musical strings are disposed.

What is claimed is:

1. A transducer for a stringed instrument having a bridge which at least in part defines an opening, said transducer adapted to be at least partially disposed in the opening and comprising;

an electrically conductive base plate, a piezoelectric crystal having one and another side, a conductive adhesive for fixedly securing said one side of the piezoelectric crystal to the base plate while providing electrical conductivity therebetween, electrical lead means for coupling signals from the piezoelectric crystal, said electrical lead means including a pair of conductors, one of which is conductively connected to said base plate and the other of which is conductively connected to said piezoelectric crystal, spring means for biasing the piezoelectric crystal against the bridge at said opening with the base plate in facing contact with said bridge at said bridge opening, said spring means comprising a spring base and a resilient spring leaf integral therewith, adhesive means for securing the spring base to said another side of the piezoelectric crystal, said instrument opening having opposed facing surfaces between which the base plate, crystal and spring means are disposed with the base plate in facing contact with one of said surfaces while the resilient spring leaf is in facing contact with the other of said surfaces.

2. A transducer as set forth in claim 1 wherein said base plate comprises a conductive sheet having an end tab.

3. A transducer as set forth in claim 2 wherein said one conductor is soldered to the base plate tab.

4. A transducer as set forth in claim 3 wherein the other conductor is soldered to the underside of the piezoelectric crystal.

5. A transducer as set forth in claim 1 wherein said conductive adhesive includes a conductive epoxy.

6. A transducer as set forth in claim 1 including a conductive adhesive for securing the spring means to the piezoelectric crystal.

7. A transducer as set forth in claim 1 wherein said spring leaf extends in an arc shape from one edge of the spring base in a cantilever manner.

8. A transducer as set forth in claim 7 wherein said bridge has opposite surfaces defining said bridge opening, said base plate positioned against one of those surfaces facing the strings while the spring leaf is seated against the other surface but urging the base plate into intimate contact with said one surface.

9. A transducer as set forth in claim 1 including an epoxy bead extending longitudinally to cover at least part of said lead means and along an edge of said piezoelectric crystal to provide support therebetween.

10. A transducer as set forth in claim 1 wherein said opening is defined between the bridge and the body of the instrument.

11. A transducer as set forth in claim 10 including a spacer supported from the instrument body and disposed between the body and the spring means.

12. A transducer as set forth in claim 1 further including a spacer disposed in said opening and against which the spring means is urged.

13. In combination, a stringed instrument comprising, an instrument body, a bridge supported from the body, means defining a slotted opening defined at least in part by the bridge and having opposed facing upper and lower opening-defining surfaces, a pickup device disposed in the slotted opening and having an integral base plate and piezoelectric sensing element, and a spring means integrally arranged with the pickup device, the spring means adapted to engage the lower surface of the slotted opening for biasing the base plate of the pickup device into intimate contact with the upper surface of the slotted opening, said piezoelectric sensing element comprising a piezoelectric crystal having one and another side and wherein said base plate comprises an electrically conductive base plate, said spring means comprising a spring base and a resilient spring leaf integral therewith, electrical lead means including a pair of conductors, one of which is conductively connected to said base plate and the other of which is conductively connected to said piezoelectric crystal, a conductive adhesive for fixedly securing said one side of the piezoelectric crystal to the base plate or providing electrical conductivity therebetween, adhesive means for securing the spring base to said another side of the piezoelectric crystal, said instrument slotted opening surfaces having the base plate, crystal and spring means disposed therebetween with the base plate in facing contact with one of said surfaces while the resilient spring leaf is in facing contact with the other of said surfaces.

14. A transducer as set forth in claim 13 wherein said base plate comprises a conductive sheet having an end tab.

15. A transducer as set forth in claim 14 wherein said one conductor is soldered to the base plate tab.

16. A transducer as set forth in claim 15 wherein the other conductor is soldered to the underside of the piezoelectric crystal.

17. A transducer as set forth in claim 13 wherein said conductive adhesive includes a conductive epoxy.

18. A transducer as set forth in claim 13 wherein said spring leaf extends in an arc-shape from one edge of the spring base.

19. A transducer as set forth in claim 18 wherein said bridge has opposite surfaces defining said bridge opening, said bridge base plate positioned against one of those surfaces facing the strings while the spring leaf is seated against the other surface but urging the base plate into intimate contact with said one surface.

20. A transducer as set forth in claim 13 including an epoxy bead extending longitudinally to cover at least part of said lead means and along an edge of said piezoelectric crystal to provide support therebetween.

21. A transducer as set forth in claim 13 wherein said opening is defined between the bridge and the body of the instrument.

22. A transducer as set forth in claim 21 including a spacer supported from the instrument body and disposed between the body and the spring means.

23. A transducer as set forth in claim 13 further including a spacer disposed in said opening and against which the spring means is urged.

* * * * *